US006813472B2

(12) United States Patent
Aizawa

(10) Patent No.: US 6,813,472 B2
(45) Date of Patent: Nov. 2, 2004

(54) SHEET FEEDING APPARATUS AND IMAGE FORMING APPARATUS

(75) Inventor: Sachiko Aizawa, Kofu (JP)

(73) Assignee: Nisca Corporation, Yamanashi-Ken (JP)

( * ) Notice: Subject to any disclaimer, the term of this patent is extended or adjusted under 35 U.S.C. 154(b) by 0 days.

(21) Appl. No.: 10/317,167

(22) Filed: Dec. 12, 2002

(65) Prior Publication Data

US 2003/0146566 A1 Aug. 7, 2003

(30) Foreign Application Priority Data

Dec. 13, 2001 (JP) ..... 2001-379845

(51) Int. Cl.[7] ..... G03G 15/00
(52) U.S. Cl. ..... 399/388; 399/407
(58) Field of Search ..... 399/381, 388, 399/390, 391, 392, 393, 394, 395, 406, 407; 271/9.01, 9.09, 145, 161, 188; 83/30, 209, 210, 405

(56) References Cited

U.S. PATENT DOCUMENTS 5,793,298 A * 8/1998 Matsuura ..... 399/407
6,219,503 B1 * 4/2001 Miyake et al. ..... 399/407
6,253,057 B1 * 6/2001 Yamanaka ..... 399/407
6,259,888 B1 * 7/2001 Kazama et al. ..... 399/406
6,361,036 B1 * 3/2002 Nakazawa ..... 399/407
6,549,734 B2 * 4/2003 Yamada et al. ..... 399/407
6,652,051 B1 * 11/2003 Kokkas ..... 399/407

* cited by examiner

*Primary Examiner*—Sandra Brase
(74) *Attorney, Agent, or Firm*—Manabu Kanesaka

(57) ABSTRACT

A sheet feeding apparatus has three sheet feeding units stacked vertically and is detachably mounted to an image forming apparatus. The upper most sheet feeding unit includes a tray for stacking and storing a sheet; a pick-up roller for feeding the sheet one at a time; a feed roller; a retard roller; a pair of register rollers; a curl forming portion for abutting against a leading edge of the sheet fed by these rollers in the sheet feeding direction to remove skew of the sheet by curling the sheet and for allowing the sheet to move further downstream; and a cylindrical cutter for punching a hole in the sheet. The sheet is transferred in a short distance and the sheet is fed one at a time.

19 Claims, 12 Drawing Sheets

SHEET FEEDING APPARATUS AND IMAGE FORMING APPARATUS

BACKGROUND OF THE INVENTION AND RELATED ART STATEMENT

The present invention relates to a sheet feeding apparatus and an image forming apparatus, and particularly relates to a sheet feeding apparatus detachably mounted to an image forming apparatus for feeding sheets one at a time, and an image forming apparatus equipped with the same.

Conventionally, in order for an image forming apparatus to file sheets with images formed thereupon, a punching process is performed on the sheets in a discharge apparatus disposed in the image forming apparatus or at downstream of the image forming apparatus. For example, Japanese Utility Model Publication (Jikkai) No. 62-92261 has disclosed technology relating to a hammer for striking a scrap receptacle device to flatten punch hole scraps inside the scrap receptacle device. Japanese Patent Publication (Tokkai) No. 04-179588 has disclosed technology relating to an automatic hole punching apparatus that is arranged near a discharge apparatus (a sorter). Japanese Patent Publication (Tokkai) No. 11-311883 has disclosed technology relating to an arrangement of a hole punching apparatus adjacent to a photoconductor drum inside of an image forming apparatus.

However, in the conventional technologies described above, the following problems are noted. a) A sheet is transferred for a considerable long distance from a sheet feeding position to a position where a hole is punched. Thus, it is easy for the sheet to be excessively skewed, thereby causing a problem of correcting the skew of the sheet. As a result, the hole tends to be punched in a wrong position in the sheet. b) In a case that the hole punching process is performed at a position in an image forming apparatus where many members are concentrated, it is difficult to remove a sheet when a paper jam occurs. Also, a scrap receptacle device needs to be disposed at a position in an image forming apparatus where many members are concentrated. Thus, it is difficult to remove punch scraps. c) A paper jam occurs more easily when punching holes than when a sheet is transferred normally. In a case that a hole punching unit where a paper jam easily occurs is arranged inside an image forming apparatus or a discharge apparatus far away from a sheet feed position, a subsequent sheet is supplied when a paper jam occurs due to the hole punching process, thereby wasting the subsequent sheet. d) In a case that the scrap receptacle device is disposed inside the image forming apparatus or below a sheet feed path in the discharge apparatus, it is necessary to extend the scrap receptacle device in the horizontal direction to ensure enough capacity to receive hole punch scraps. Therefore, the hole punch scraps are accumulated directly under hole punching members (such as a circular blade for punching holes). As a result, only a smaller amount of the punch scraps can be retained relative to an actual capacity of the scrap receptacle device, thereby decreasing space efficiency. In order to improve the space efficiency, it has been conceived to disperse the hole punch scraps to an area away from the hole punching device. However, it is required to provide a separate mechanism for shaking the hole punching device to disperse the hole punch scraps.

In view of the aforementioned problems, an object of the present invention is to provide a sheet feed apparatus and image forming apparatus in which holes are securely punched in the sheets without wasting the sheet when the paper jam occurs.

SUMMARY OF THE INVENTION

In order to attain the aforementioned objectives, according to the first aspect of the present invention, a sheet feeding apparatus detachably mounted to an image forming apparatus for feeding sheets one at a time includes storage means for stacking and storing the sheets, sheet feeding means for feeding the sheets stacked and stored in the storage means one at a time, register means for abutting against a leading edge of the sheet fed by the sheet feeding means in a feeding direction and for allowing the sheet to move further downstream after removing skew of the sheet by curling the sheet, and hole punching means for punching holes in the sheets whose skew is removed by the register means.

According to this aspect of the present invention, the sheets are stacked and stored in the storage means, and the sheet feeding means feeds the sheets stacked and stored in the storage means one at a time. The register means abuts against the leading edge of the sheet fed by the sheet feeding means in the sheet feeding direction for curling the sheet to remove the skew thereof, and then allows the sheet to travel further downstream. Then, the hole punching means punches the holes in the sheets whose skew is removed by the register means. According to this aspect, because the sheet feeding apparatus itself is provided with the hole punching means, the sheet is transferred for a short distance, thereby making it difficult for the skew (shift) to happen when the sheet is transferred. Therefore, it is easier for the register means to correct the skew of the sheet, and it is possible for the hole punching means to punch the hole in the sheet more accurately. The hole punching means where a paper jam easily occurs is disposed in the sheet feeding apparatus, and the sheets are fed one at a time from the sheet feeding means. Therefore, a subsequent sheet is not fed when the paper jam occurs, thereby eliminating sheet waste. In this case, in addition to the hole punching members for punching the hole in the sheet, if the hole punching means includes scrap receptacle means for receiving hole punch scraps from the sheets with holes punched by the hole punching member, the sheet feeding apparatus itself can receive the hole punch scraps with the scrap receptacle means, thereby making it easy to discard the scraps.

In order to solve the aforementioned issues, according to the second aspect of the present invention, a sheet feeding apparatus detachably mounted to an image forming apparatus for feeding sheets one at a time includes storage means for stacking and storing the sheets; sheet feeding means for feeding the sheets stacked and stored in the storage means one at a time; register means for abutting against a leading edge of the sheet fed by the sheet feeding means in a sheet feeding direction and for allowing the sheet to move further downstream after removing skew of the sheet by curling the sheet; a sheet feed path for guiding the sheet fed by the sheet feeding means in a vertical direction; hole punching means for punching holes in the sheets guided in the sheet feed path; and scrap receptacle means disposed along the sheet feed path for receiving hole punch scraps from the sheet with holes punched by the hole punching means. According to this aspect, the scrap receptacle means is disposed along the sheet feed path arranged substantially vertically to receive the hole punch scraps. Thus, in addition to the effects attained through the first aspect, it is possible to provide a space for disposing the scrap receptacle means easily. Furthermore, the scrap receptacle means is disposed extending substantially in the vertical direction. Thus, the hole punch scraps are dispersed while falling to fill the scrap receptacle means from the bottom, thereby making it possible to omit a structure for dispersing the hole punch scraps inside the scrap receptacle means as shown in the conventional apparatus.

According to the third aspect of the present invention, a sheet feeding apparatus detachably mounted to an image forming apparatus has a plurality of sheet feeding units that can be stacked in a vertical direction. The sheet feeding units include storage means for stacking and storing sheets; sheet feeding means for feeding the sheets stacked and stored in the storage means one at a time; and sheet feeding path for guiding the sheet fed by the sheet feeding means to the image forming apparatus. The sheet feeding apparatus feeds the sheets to the image forming apparatus one at a time. At least one of the sheet feeding units located at the farthermost downstream in the sheet feeding direction is provided with hole punching means for punching a hole in the sheet guided to the sheet feeding path. According to this aspect, among the stacked sheet feeding units, at least one of the sheet feeding units located at the farthermost downstream in the sheet feeding direction is provided with hole punching means. Accordingly, the feeding unit can perform the hole punching process on the sheet fed from any other sheet feeding units, thereby making the sheet feeding apparatus compact and simple. In this case, similar to the first and the second aspects of the invention, it is preferable that at least the sheet feeding unit located at the farthermost downstream is provided with register means for abutting against a leading edge of the sheet fed by the sheet feeding means in the sheet feeding direction and for allowing the sheet to move toward downstream after removing skew of the sheet by curling the sheet. It is also preferable to form the sheet feeding path in a substantially vertical direction, and to provide scrap receptacle means extending along the sheet feeding path for receiving hole punch scraps from the sheet punched by the hole punching means.

Also, in the second and third aspects, the scrap receptacle means may be arranged on a side opposite to the sheet feeding means with the sheet feeding path in between. Thus, it is possible to dispose the scrap receptacle means extending along the sheet feeding path without any restriction in a space caused by the sheet feeding means. In this case, opening and closing means may be further provided at a side opposite to the sheet feeding means with the sheet feeding path in between so that an operator can access to the scrap receptacle means. Further, in the first to third aspects, support means may be provided, so that the support means can support the storage means and hole punching means to be movable between a sheet feeding position where the sheet feeding means feeds the sheets one at a time and a refilling position where the sheets are refilled in the sheet feeding means. Thus, the storage means and hole punching means can be moved to the refilling position with the support means, thereby making it possible to handle a paper jam easily. Also, in a case that the scrap receptacle member and the scrap receptacle means are moved together to the refilling position, it is possible to discard the scraps easily from the scrap receptacle member or the scrap receptacle means. Further, in a case that hand-feed means is disposed at upstream of the hole punching means for manually feeding the sheets, it is possible that the hole punching means punches holes in the sheet fed manually as well as the sheet fed from the sheet feeding means.

According to the fourth aspect of the present invention, an image forming apparatus is provided with the sheet feeding apparatus according to the first to the third aspects. An image forming apparatus may be provided with the sheet feeding apparatus described above.

BRIEF DESCRIPTION OF THE DRAWINGS

FIGS. 10(A)-10(B) are sectional views of a copier of another embodiment to which the present invention is applicable, wherein FIG. 10(A) shows a state where a door is closed, and FIG. 10(B) shows a state where the door is opened;

DETAILED DESCRIPTION OF THE PREFERRED EMBODIMENTS

Hereunder, embodiments in which the present invention is applied to a copier will be explained with reference to the drawings.

(Structure)

Figure 1:
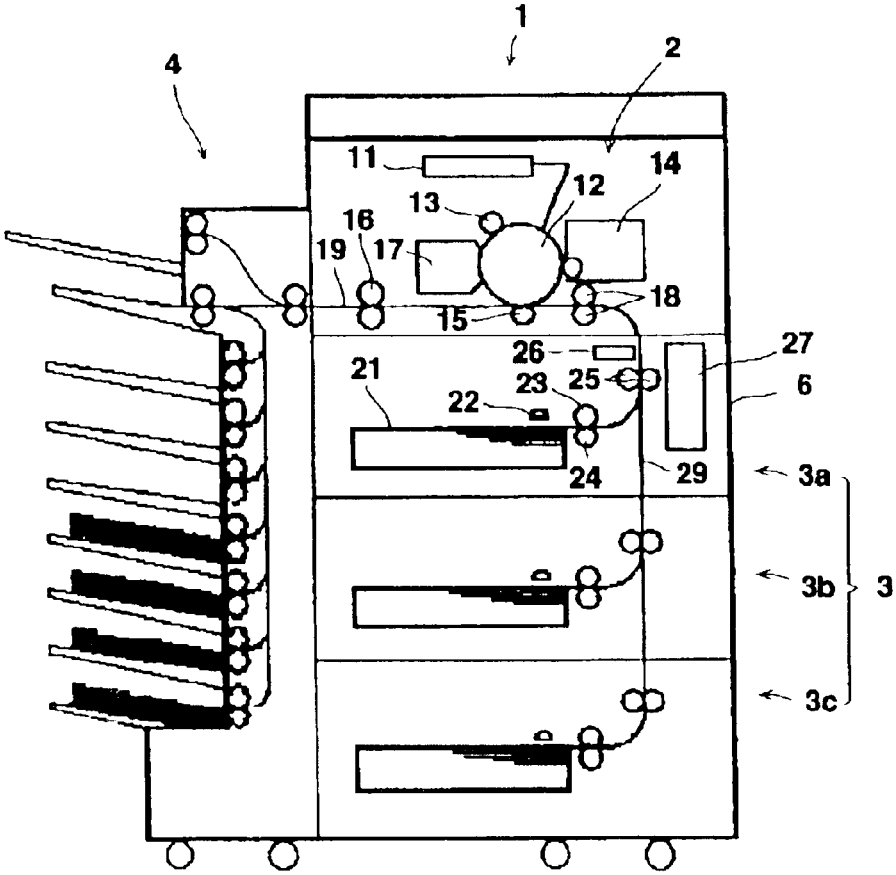
FIG. 1 is a sectional view of a copier of an embodiment to which the present invention is applicable.

As shown in FIG. 1, a copier 1 of the embodiment comprises an image forming apparatus 2 for forming an image on a sheet; a sheet feeding apparatus 3 arranged at upstream of the image forming apparatus 2 for feeding the sheets to the image forming apparatus 2 one at a time; a discharge apparatus 4 arranged at downstream of the image forming apparatus 2 and having a sorter and the like; a control unit (hereinafter referred to as a main control unit) including a display/operation panel such as a touch-panel (not shown) and a CPU.

The image forming apparatus 2 is provided with a photosensitive drum 12 at a center thereof for forming a latent image on an outer surface thereof through an optical system 11. In the vicinity surrounding the photosensitive drum 12 are arranged a developer 14 for developing the latent image formed on the photosensitive drum 12 into a toner image, a cleaner 17 for cleaning the photosensitive drum 12, and an electrostatic charge roller 13 for supplying an electrical charge to the photosensitive drum 12 for forming the latent image. A transfer roller 15 is disposed at a position opposite to the photosensitive drum 12 with a sheet transfer path 19 in between, and presses against the photosensitive drum 12 with the sheet in between for transferring the latent image formed on the outer surface of the photosensitive drum 12 to the sheet. A pair of transfer rollers 18 is arranged at upstream of the photosensitive drum 12 along the sheet transfer path 19, and converts a feeding direction of the sheet fed from the sheet feeding apparatus 3 into a substantially horizontal direction for transferring the sheet to the photosensitive drum 12. In addition, a fixer 16 having a heat roller is arranged at downstream of the photosensitive drum 12 along the sheet transfer path 19 for heating and fixing the toner image transferred to the sheet. The main control unit controls an operation of each of these units in the image forming apparatus 2 according to information that an operator inputs via a display/operation panel.

The sheet feeding apparatus 3 has a structure that is mountable to the image forming apparatus 2, and comprises sheet feeding units 3*a*, 3*b* and 3*c* stacked in three levels in a vertical direction. These three sheet feeding units 3*a*, 3*b* and 3*c* are composed of substantially the same members. Hereunder, the uppermost (the furthermost downstream unit) sheet feeding unit 3*a* will be explained as a representative. The sheet feeding units 3*b* and 3*c* will be explained with respect only to differences from the sheet feeding unit 3*a*.

Figure 2:
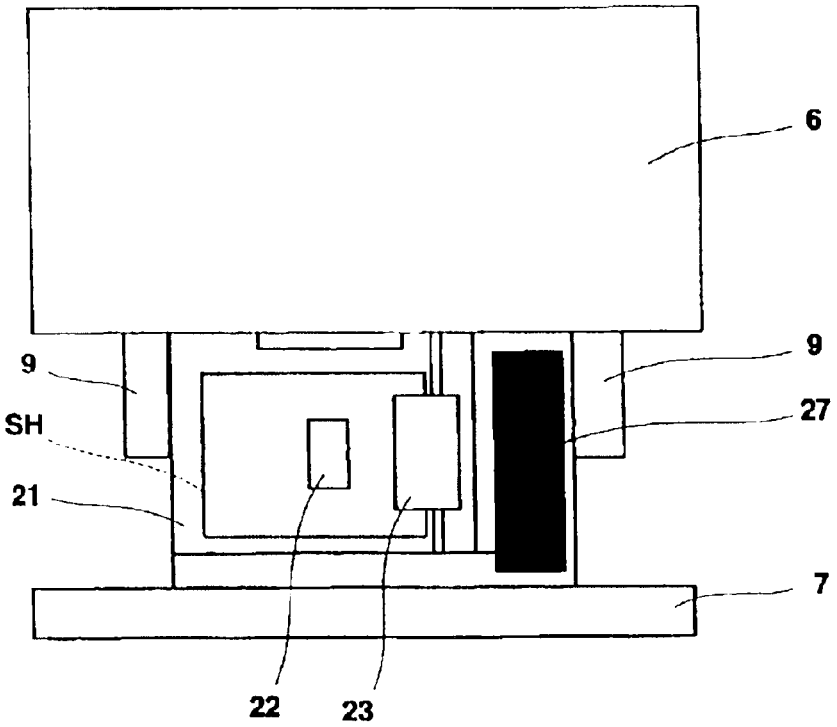
FIG. 2 is a plan view of the copier according to the embodiment in a state where a sheet feeding unit at the uppermost level moves to a sheet refilling position.
Figure 3:
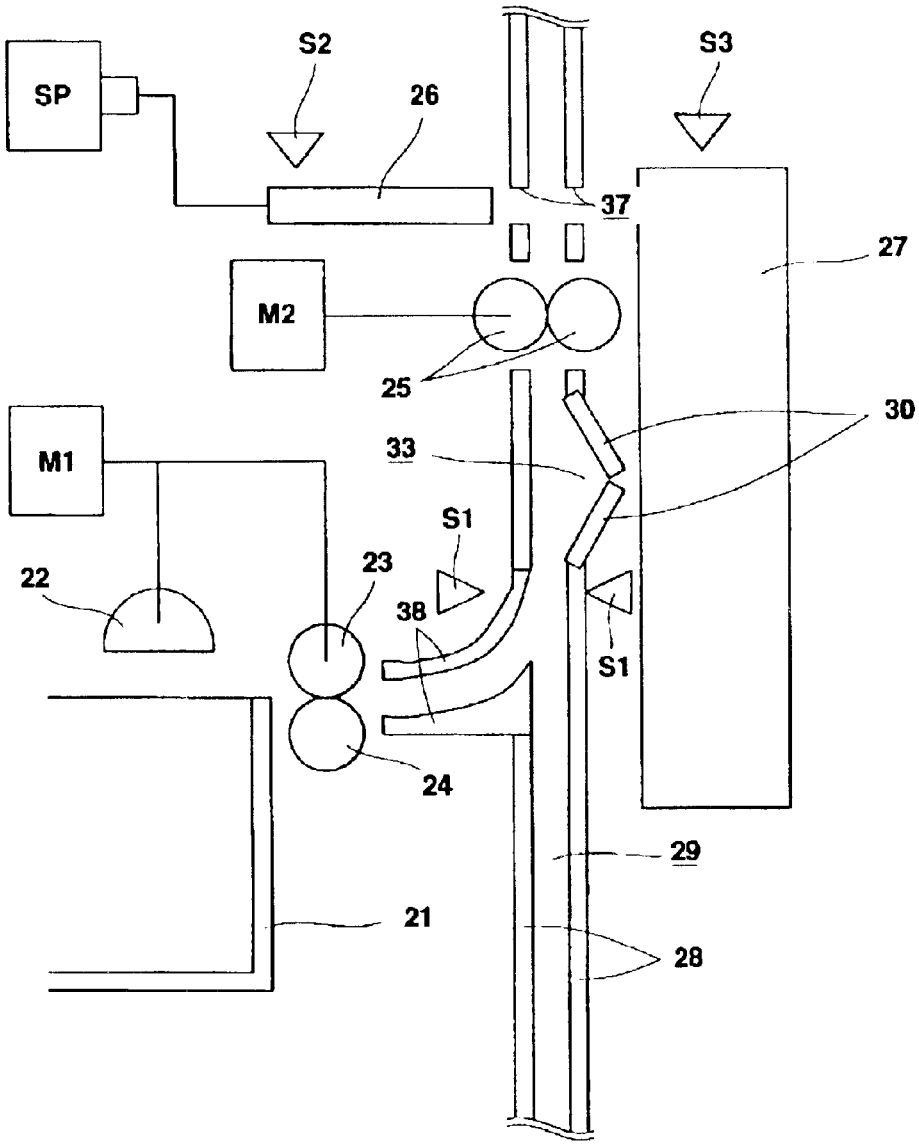
FIG. 3 is a partially expanded view of the sheet feeding unit at the uppermost level according to the embodiment.

As shown in FIG. 1 to FIG. 3, the sheet feeding unit 3*a* comprises the sheet supply tray 21 that can stack and store the sheets inside of the main unit frame 6. The sheet supply tray 21 comprises a spring (not shown) for urging a leading edge of the box-shaped tray in the sheet feeding direction from a bottom, and a stopper (not shown) for controlling a height position of leading edges of the sheets in the sheet feeding direction stacked and stored on the uppermost portion at a constant position.

A semi-circular pick-up roller 22 is disposed on an upper position of the sheet supply tray 21 at a leading edge side in the sheet feeding direction, and is driven by a pulse motor M1 to feed the uppermost sheet in the sheet supply tray 21 one at a time from the sheet supply tray 21. The drive of the pulse motor M1 is transmitted to the pick-up roller 22 via gears (not shown). A feed roller 23 and a retard roller 24 are disposed close to a sidewall of the sheet supply tray 21. The feed roller 23 transfers the sheet fed from the sheet supply tray 21 toward a vertical sheet transfer path 29 extending in the substantially vertical direction through a transfer guide 28. The retard roller 24 separates the sheets fed from the sheet supply tray 21 into a single sheet. The feed roller 23 and retard roller 24 rotate in a predetermined direction via gears (not shown) by the rotational drive of the pulse motor M1 (see FIG. 4).

A guide member 38 is disposed at downstream of the feed roller 23 and retard roller 24 for guiding the sheet to the vertical sheet transfer path 29. The guide member 38 is formed of two members, i.e. an upper guide member and a lower guide member, extending from the transfer guide 28 (hereinafter referred to as a tray side guide) at the side of the sheet supply tray 21. There is a gap having a substantially R shape between the upper guide member and the lower guide member.

A transmissive type sensor S1 composed of a light emitting element and a light receiving element is arranged on the transfer guide 28 (hereinafter referred to as a frame side guide) at a side opposite to the tray side guide, i.e. near an upper portion of the upper guide member and at the same height thereof, for detecting a leading edge of the sheet in the sheet feeding direction. Small windows (not shown) are formed in the upper guide member and the frame side guide, and correspond to positions where the transmissive type sensor S1 is arranged.

Curl forming members 30 composed of two substantially v-shaped pieces are arranged at an upper portion (downstream) of the transmissive type sensor S1 on the frame side guide at a side of a scrap receptacle 27 (described in detail below). The curl forming members 30 curl the sheet to have a play at an isosceles triangle space 33 for a register loop formed in the vertical sheet transfer path 29. A pair of register rollers 25 is arranged above an upper portion of the curl forming members 30 for abutting against the leading edge of the sheet in the sheet feeding direction to remove skew of the sheet in cooperation with the space 33 for a register loop. The pulse motor M2 drives the pair of the register rollers 25 via gears (not shown) to rotate.

A cutter penetration circular hole 37 is formed above the pair of the register rollers 25 of the transfer guide 28. A cylindrical cutter 26 having a cylindrical cutter blade is arranged at a side of the sheet supply tray 21 of the cutter penetration hole 37. The cylindrical cutter 26 is connected to a plunger of a solenoid SP. The plunger is protruded from the solenoid SP to insert the cylindrical cutter 26 into the cutter penetration hole 37, thereby punching a hole at a predetermined position of the sheet nipped by the pair of the register rollers 25. A reflective type sensor S2 is disposed above the cylindrical cutter 26 for detecting a position of the cylindrical cutter 26.

A scrap receptacle 27 extending along the vertical sheet transfer path 29 is disposed at a side opposite to the sheet supply tray 21 (the side near the main unit frame 6) with sandwiching the vertical sheet transfer path 29 in between for receiving sheet hole scraps punched by the cylindrical cutter 26. A circular opening corresponding to a position of the cylindrical cutter 26 is formed in the scrap receptacle 27. When punching a hole in the sheet (see FIG. 7), the blade end of the cylindrical cutter 26 enters the scrap receptacle 27 through the opening. A reflective type sensor S3 is disposed above the scrap receptacle 27 for detecting whether the scrap receptacle 27 is attached.

In addition, the sheet feeding unit 3*a* is provided with a control unit (not shown) having a CPU block for controlling the sheet feeding unit 3*a*. The CPU block is composed of a CPU operating as a central processing unit, an ROM for storing a basic control program for the sheet feeding unit 3*a*, an RAM operating as a CPU work area, and an internal bus for connecting them together. The CPU block is connected to an external bus. The external bus is connected to a drive control unit for controlling motor drivers (not shown) that drive the pulse motors M1 and M2; a solenoid control unit for controlling the solenoid SP; and an interface for sending and receiving a signal between the main control unit and the sheet feeding units 3*b*, 3*c*.

As shown in FIG. 2, the guide rails 9 have plurality of pulleys (not shown) and are arranged on both side of the sheet supply tray 21. The guide rails 9 support the sheet supply tray 21 housed inside of the main unit frame 6 along with the cylindrical cutter 26 (not shown in FIG. 2) and the scrap receptacle 27 to be movable between a sheet supplying position for supplying the sheet to the image forming apparatus 1 shown in FIGS. 1, 3 and a sheet refilling position where an operator of the copier 1 refills the sheets SH into the sheet supply tray 21. A front face 7 has a handle (not shown), and the operator uses this handle to move the sheet supply tray 21 from the sheet supply position to the sheet refilling position, and then return it to the sheet supply position after refilling the sheets SH in the sheet supply tray 21. Therefore, the guide rails 9 support the sheet supply tray 21, the cylindrical cutter 26 and the scrap receptacle 27 to be movable between the sheet supply position and the sheet refilling position.

On the other hand, the sheet feeding units 3*b* and 3*c* are different from the sheet feeding unit 3*a* in terms of not having a mechanism for punching the holes in the sheet. Specifically, the sheet feeding units 3*b* and 3*c* do not include the solenoid SP, the cylindrical cutter 26, the reflective sensors S2, the cutter penetration hole 37 formed in the vertical sheet transfer path 29, the scrap receptacle 27, and the reflective sensor S3. The sheet feeding units 3*b* and 3*c* also do not have the curl forming members 30 and are not provided with the space 33 for the register loop. Furthermore, to transport the sheet SH at a sufficient speed, a pair of transfer rollers without a register action is used instead of the pair of the register rollers 25.

Note that the transfer guides 28 in the sheet feeding units of 3*a*, 3*b* and 3*c* are connected with each other in the vertical direction. The vertical sheet transfer paths 29 for the sheet feeding units of 3*a*, 3*b* and 3*c* are connected with each other vertically, and the interface ports of the control units in the sheet feeding units of 3*a*, 3*b* and 3*c* are connected through a lead wire with a connector (not shown). As shown in FIG. 1, the vertical sheet transfer path 29 of the sheet feeding unit 3*a* is communicated with the sheet transfer path 19 on the image forming apparatus 2.

(Operations)

Next, an operation of the copier 1 according to the embodiment will be explained with main focus on an operation of the sheet feeding apparatus 3. First, it is supposed that starting from the sheet feeding unit 3*a*, the sheet SH is fed from the sheet feeding apparatus 3 to the image forming apparatus 2, and the CPU (hereinafter referred to as the CPU) in the sheet feeding unit 3*a* will be explained mainly.

Figure 4:
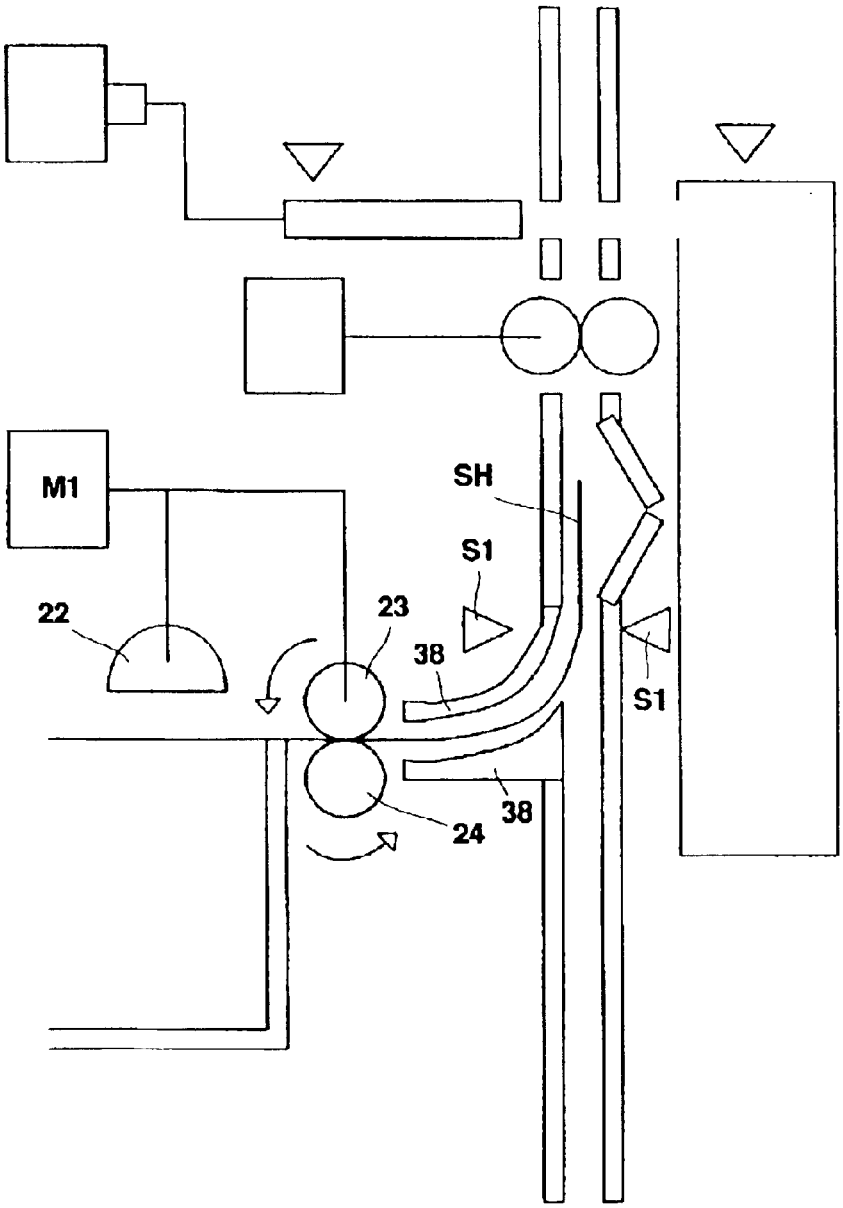
FIG. 4 is a view schematically showing the first step of an operating of the sheet feeding unit at the uppermost level according to the embodiment.

The CPU is idle until a sheet feed signal is received from the main control unit described above. When the signal is received, it determines whether a hole punching mode for punching the hole in the sheet SH is selected according to the signal information included in the sheet feed signal (or a separate signal from the sheet feed signal). If it is the case, a signal for driving the pulse motor M1 in reverse is sent to the driver control unit. With this process, the driver control unit drives the pulse motor M1 to rotate in reverse, thereby rotating the pick-up roller 22 once to draw out the upper most sheet SH in the sheet supply tray 21 from the sheet supply tray 21. Next, the CPU outputs a signal to the driver control unit for driving the pulse motor M1 in forward to rotate the feed roller 23 and the retard roller 24 in a predetermined direction. With this process, as shown in FIG. 4, the leading edge of the sheet SH in the sheet feeding direction is guided to the vertical sheet transfer path 29 through the guide members 38.

Figure 5:
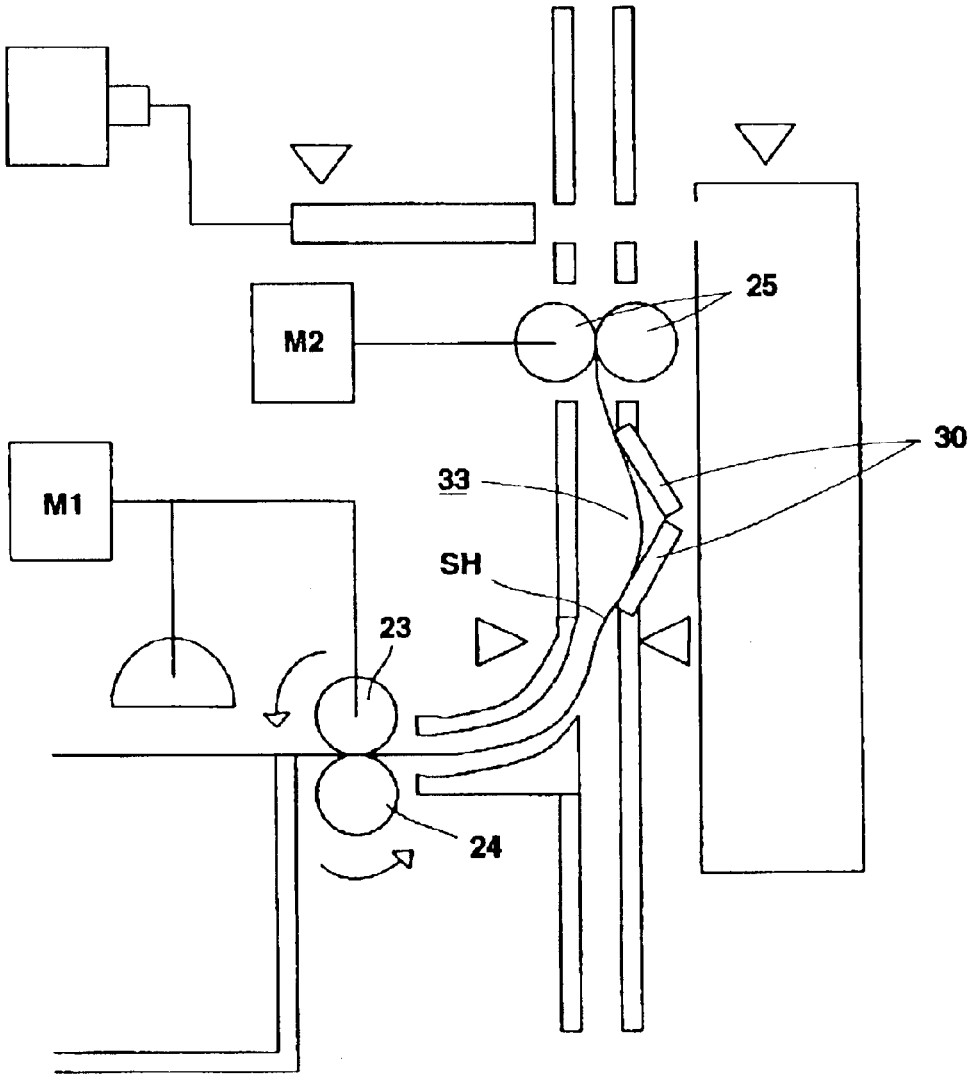
FIG. 5 is a view schematically showing the second step of the operating of the sheet feeding unit at the uppermost level according to the embodiment.

Next, the CPU determines whether the leading edge of the sheet SH in the sheet feeding direction is detected according to a signal from the transmissive type sensor S1. If it is the case, the feed roller 23 and the retard roller 24 continue to rotate. If it is not the case, the driver control unit drives the pulse motor M1 in the forward direction by a predetermined number of pulses according to the information of the first predetermined pulse count stored in the ROM in advance. The first predetermined pulse count is set to be enough pulses so that, as shown in FIG. 5, the leading edge of the sheet in the sheet feeding direction abuts against the pair of the register rollers 25 to form a curl in the sheet SH (the sheet bends) at the space for the register loop after the transmissive type sensor S1 detects the leading edge of the sheet SH in the sheet feeding direction. With this process, the leading edge of the sheet SH abuts against the pair of the register rollers 25*a* to form a curl at the space 33 for the register loop. Therefore, even if the sheet SH fed from the sheet supply tray 21 is skewed (front and back edges of the sheet SH in FIG. 4 pass on different positions, and the sheet is slanted), the curl eliminates a delay in the feeding of either the front or back edges of the sheet SH, shown in FIG. 5, thereby removing the skew of the sheet SH.

Figure 6:
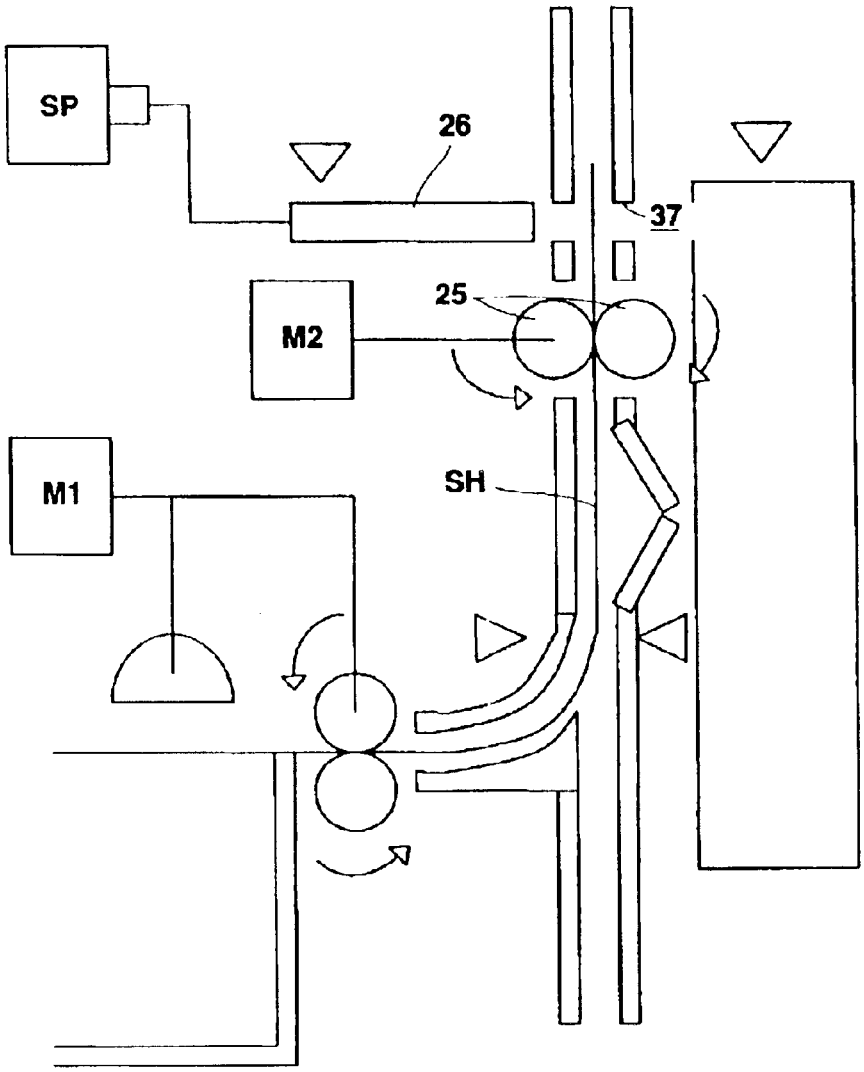
FIG. 6 is a view schematically showing the third step of the operating of the sheet feeding unit at the uppermost level according to the embodiment.

Next, as shown in FIG. 6, the CPU makes the driver control unit to drive the pulse motor M2 by the second predetermined number of pulses to rotate the pair of the register rollers 25 according to the second predetermined number of pulses stored in the ROM in advance. The second predetermined pulse count is set to be enough pulses so that the pair of the register rollers 25 rotates to move the leading edge of the sheet SH in the sheet feeding direction through the cutter penetration hole 37 to a predetermined position for punching the hole in the sheet SH after the skew is removed from the sheet SH by the output of the first predetermined pulse count. At this time, the pulse motor M1 also rotates in forward, and the leading edge of the sheet SH in the sheet feeding direction is transferred toward an upper direction (or downstream) inside of the vertical sheet transfer path 29 by the drive of the pulse motors M1 and M2.

Figure 7:
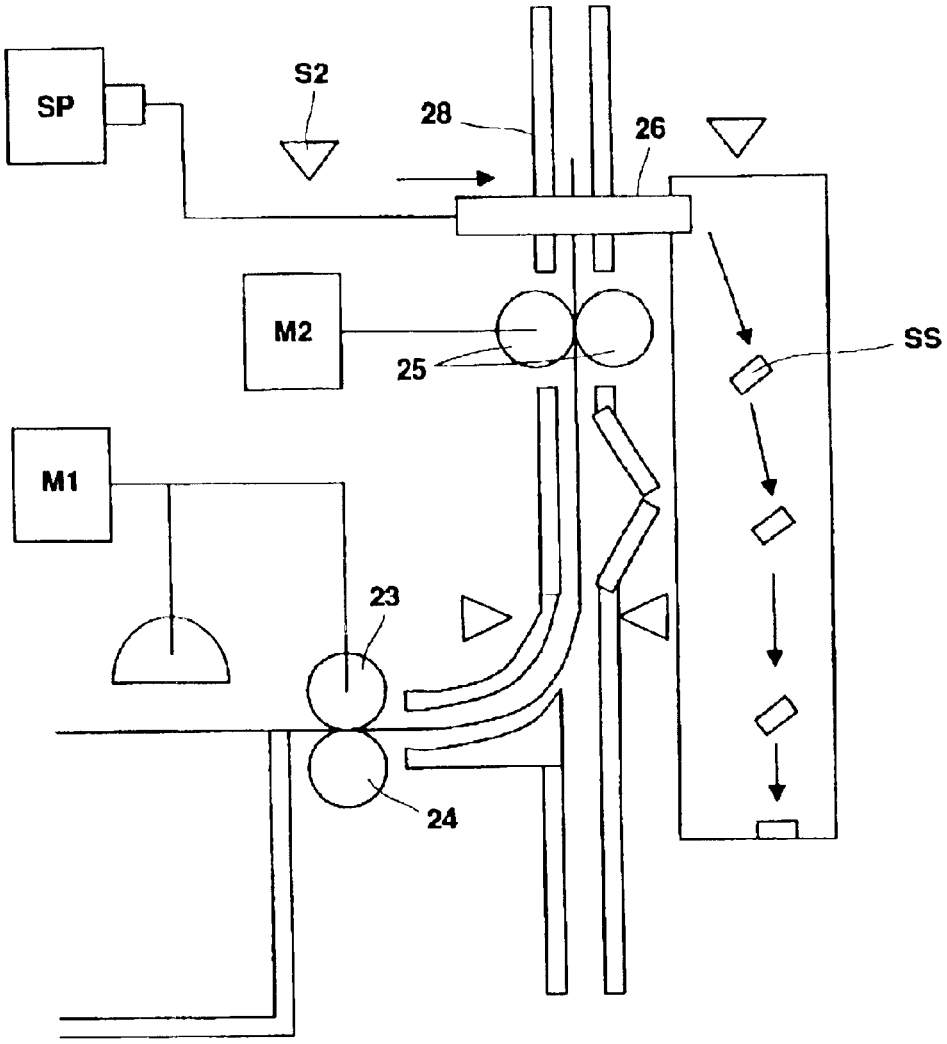
FIG. 7 is a view schematically showing the fourth step of the operating of the sheet feeding unit at the uppermost level according to the embodiment.

The CPU stops both the pulse motor M1 and the pulse motor M2 after the driver control unit drives the pulse motor M2 for the second predetermined pulse count. Next, the CPU sends a signal to the solenoid control unit to protrude the plunger from the solenoid SP, thereby inserting the cylindrical cutter 26 connected to the plunger into the cutter penetration hole 37. With this process, as shown in FIG. 7, the hole is punched at a predetermined position in the sheet SH nipped by the pair of the register rollers 25, the feed roller 23 and the retard roller 24. Hole punch scraps SS of the sheet SH punched by the cylindrical cutter 26 fall through the opening in the elongated scrap receptacle 27, and are separated (dispersed) to accumulate in the scrap receptacle 27 from the bottom.

The CPU idles until the reflective type sensor S2 detects the cylindrical cutter 26 after sending a signal to the solenoid control unit. When the reflective type sensor S2 detects the cylindrical cutter 26, the CPU sends a signal to the driver control unit to drive the pulse motors M1 and M2 again to feed the sheet SH to the image forming apparatus 2. The driver control unit drives the pulse motors M1 and M2 by a pulse count to transfer the sheet SH to the image forming apparatus 2 according to the information of the third predetermined pulse count stored in ROM. Note that the CPU determines that the cylindrical cutter 26 punches the hole in the sheet SH when the signal from the reflective type sensor S2 changes from ON to OFF to ON.

On the other hand, if it is determined that the hole punching mode for punching the hole in the sheet SH is not selected based on the information included in the sheet feeding signal (or a separate signal from the sheet feeding signal), the CPU makes the driver control unit to drive the pulse motors M1 and M2 by the third predetermined pulse count to transfer the sheet SH to the image forming apparatus 2 without punching the hole in the sheet SH after making the driver control unit to drive the pulse motor M2 by the second predetermined pulse count.

The CPU idles until the sheet feed signal is received from the main apparatus control unit, and then repeats the routine described above. Note that the CPU detects whether the scrap receptacle 27 is mounted through the reflective type sensor S3. When the scrap receptacle 27 is not mounted, the CPU sends a signal to the main apparatus control unit. Upon receiving the signal, the main apparatus control unit displays a message on the display/operation panel that the scrap receptacle 27 is not mounted.

According to a direction from the main apparatus control unit, the image forming apparatus 2 forms an image on the sheet SH fed from the sheet feeding apparatus 3, and then transfers the sheet to the discharge apparatus 4. The discharge apparatus 4 discharges the sheet SH with the image formed thereon out of the copier 1 according to the discharge mode instructed by the operator through the display/operation panel.

Next, an operation of feeding the sheet from either the sheet feeding unit 3*b* or sheet feeding unit 3*c* to the image forming apparatus 2 will be explained.

Figure 8:
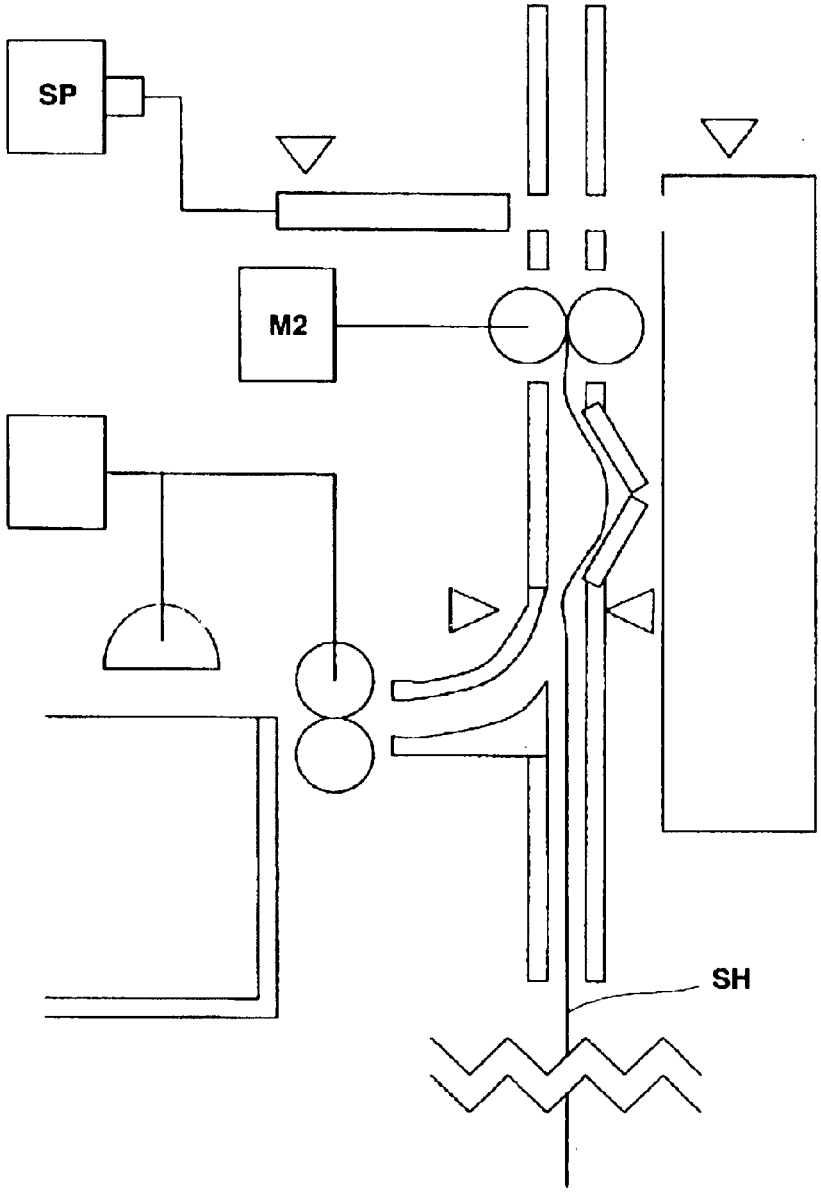
FIG. 8 is a view schematically showing an operation of the sheet feeding unit at the uppermost level when a sheet is fed from a sheet feeding unit at a mid-level or the lowest level according to the embodiment, and corresponding to the second step of the operation shown in FIG. 5.
Figure 9:
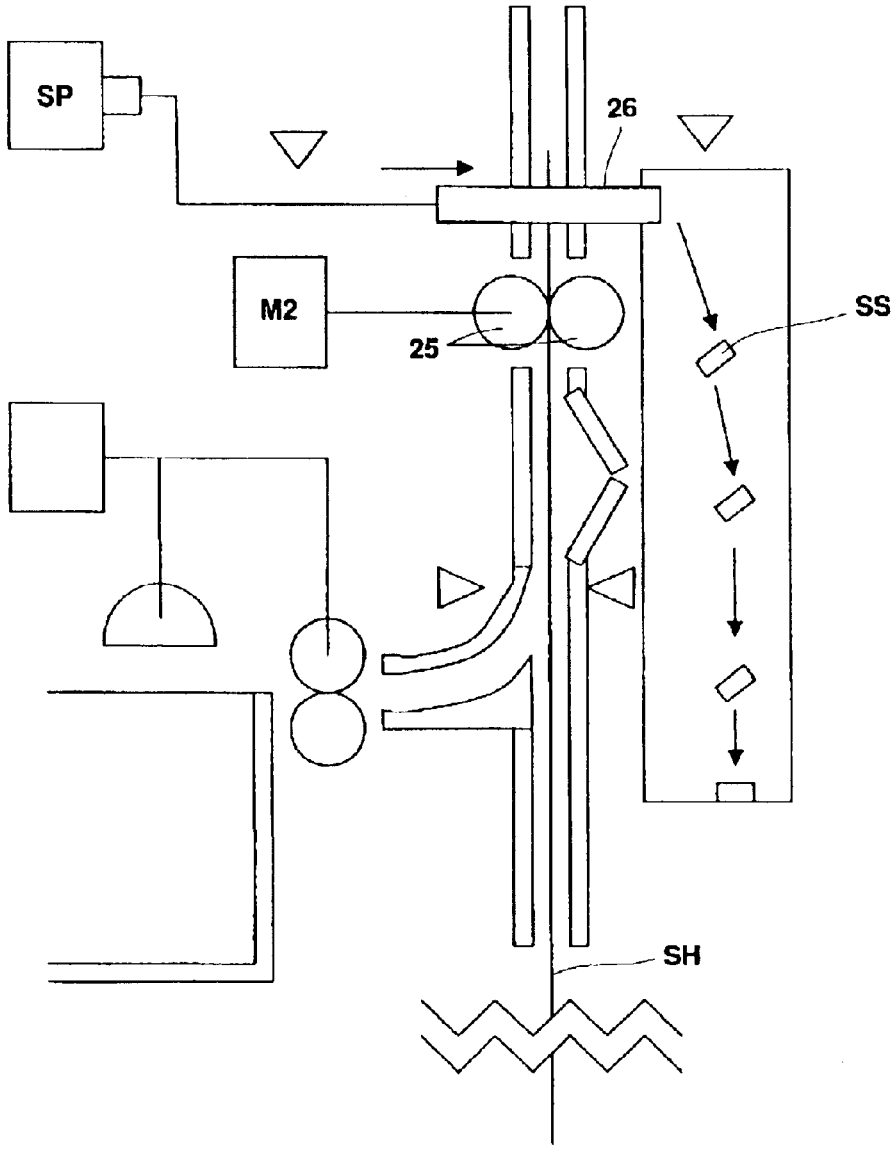
FIG. 9 a view schematically showing the operation of the sheet feeding unit at the uppermost level when a sheet is fed from a sheet feeding unit at a mid-level or the lowest level according to the embodiment, and corresponding to the fourth step of the operation shown in FIG. 7.

As described above, the vertical sheet transfer paths 29 of the sheet feeding units of 3*a*, 3*b* and 3*c* are connected with each other. Therefore, it is possible to transfer the sheet fed from either one of the sheet feeding units 3*b*, 3*c* disposed below the sheet feeding unit 3*a* in the vertical sheet transfer paths 29 toward the upper direction. To support to transfer the sheet, when the sheet SH is fed from the sheet feeding unit of 3*c*, the pulse motor M2 in the sheet feeding units 3*b*, 3*a* is driven along with the pulse motors M1 and M2 in the sheet feeding unit of 3*c*. When the sheet SH is fed from the sheet feeding unit 3*b*, the pulse motor M2 in the sheet feeding unit 3*a* is driven along with the pulse motors M1 and M2. That is, when the sheet is fed from the sheet feeding unit 3*c*, the sheet feeding unit 3*c* sends the third predetermined pulse count to the driver control unit to drive the pulse motors M1 and M2. Also, the control unit of the sheet feeding unit 3*c* sends a signal to the control units of the sheet feeding units 3*a*, 3*b* via the interface unit to drive each of the pulse motors M2 in the sheet feeding units 3*a*, 3*b*. Upon receiving these signals, the CPU instructs to drive each of the pulse motors M2 in the sheet feeding units 3*a*, 3*b*. As shown in FIG. 8 and FIG. 9, when the skew removal and hole punching modes are selected, the sheet feeding unit 3*a* punches the hole in the sheet SH fed from the sheet feeding unit 3*c*.

(Actions and Effects)

Actions and effects of the copier 1 of the present embodiment will be explained with main focus on actions and effects of the sheet feeding units 3.

In the sheet feeding unit 3*a* according to the present embodiment, the sheet SH is stacked and stored in the sheet supply tray 21. The pulse motor M1 drives the pick-up roller 22, feed roller 23 and the retard roller 24 to feed the upper most sheet SH from the sheet supply tray 21 one at a time. Then, in the sheet feeding unit 3*a*, the pair of the register rollers 25 and the curl forming member 30 make the leading edge of the sheet SH in the sheet feeding direction abut against the pair of register rollers 25, and allows the sheet SH to move toward downstream after removing the skew of the sheet at the space 33 for the register loop by curling the sheet SH. Then, before the leading edge of the sheet SH without the skew in the sheet feeding direction reaches the photosensitive drum 12, the cylindrical cutter 26 with the solenoid SP as the actuator punches the hole at a predetermined position in the sheet SH. Therefore, because the sheet feeding units 3 themselves are equipped with the cylindrical cutter 26, the sheet moves from the sheet supply tray 21 to the hole punching position (the position of the cylindrical cutter 26) in a short distance, thereby reducing any skewing as the sheet SH moves. For that reason, it is easy to correct the skew of the sheet SH at the space 33 for the register loop using the register roller 25 and the curl forming members 30, thereby making it possible to punch the hole in the sheet SH accurately. Further, the cylindrical cutter 26 and cutter penetration hole 37 where a paper jam easily can occur are arranged in the sheet feeding unit 3*a*, and the sheet SH is fed from the sheet supply tray 21 one at a time. Therefore, when the paper jam occurs, the subsequent sheet SH is not fed, thereby preventing the waste. Further, the hole is not punched when the photosensitive drum 12 forms the image upon the sheet SH, so that the image is formed on the sheet SH accurately without being affected by vibrations due to the hole punching process. In this case, a distance from the photosensitive drum 12 to the cylindrical cutter 26 may be set longer than a length in the transfer direction of the maximum size sheet to be handled, so that the image is formed on the sheet SH accurately without being affected by the vibrations due to the hole punching process, and it is possible to punch the hole in the trailing edges of all the sheets SH in the sheet feeding direction.

Also, according to the embodiment, the scrap receptacle 27 for receiving the hole punch scraps SS of the sheet SH punched by the cylindrical cutter 26 is not disposed in the image forming apparatus 2 or the discharge apparatus 4 where component members are disposed and crowded. Instead, the scrap receptacle 27 is arranged in the sheet feeding unit 3*a*, so that the sheet feeding unit 3*a* itself can receive the hole punch scraps SS with the scrap receptacle 27. Additionally, in the embodiment, the scrap receptacle 27 is situated on the side opposite to the sheet supply tray 21 with the vertical sheet transfer path 29 in between. Accordingly, it is possible to arrange the scrap receptacle 27 extending along the vertical sheet transfer path 29 without space restriction of the sheet supply tray 21. Also, according to the embodiment, the scrap receptacle 27 for receiving the hole punch scraps SS is disposed along the vertical sheet transfer path 29 in the substantially vertical direction (or is vertically elongated). Therefore, it is not necessary to provide a separate space for the scrap receptacle 27. Further, the scrap receptacle 27 is formed in the elongated shape, so that the hole punch scraps SS fall and scatter to accumulate on the scrap receptacle 27 from the bottom, thereby eliminating the mechanism for dispersing the hole punch scraps SS in the scrap receptacle 27 as shown in the prior art.

Further, according to the embodiment, the guide rails 9 support the sheet supply tray 21 along with the cylindrical cutter 26 and the scrap receptacle to be movable between the sheet supply position for feeding the sheets SH and the sheet refilling position for refilling the sheets SH into the sheet supply tray 21. Therefore, the operator can move the sheet supply tray 21 from the sheet supply position to the refilling position by grabbing the handle formed on the front face 7, thereby making it easy to handle the paper jam and to remove the waste from the scrap receptacle 27.

Further, according to the embodiment, among the sheet feeding units 3*a*, 3*b* and 3*c* stacked in three levels, the sheet feeding unit 3*a* has the cylindrical cutter 26. Therefore, in the sheet feeding unit 3*a*, the holes can be punched in the sheets SH fed from the other sheet feeding units 3*b* and 3*c*, thereby making the sheet feeding apparatus 3 compact and reducing the cost.

Figure 10A:
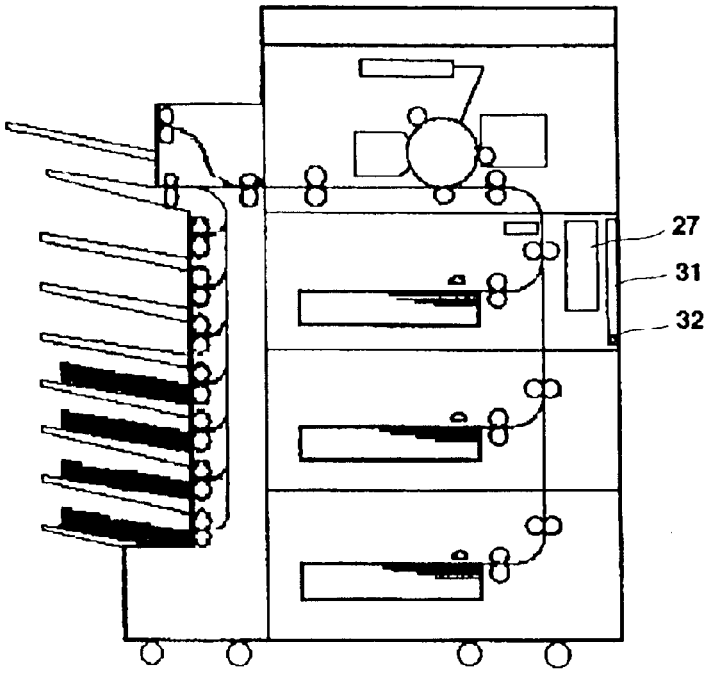
Figure 10B:
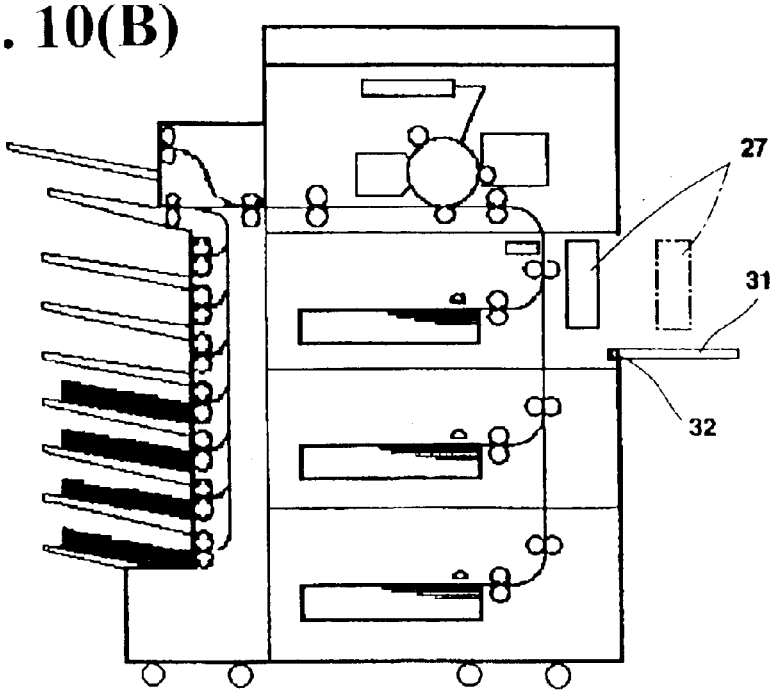

In the embodiment, the sheet supply tray 21 moves from the sheet supply position to the sheet refilling position to remove the paper jam or discard the hole punching scraps SS in the scrap receptacle 27. Alternatively, as shown in FIG. 10(A), the main unit frame 6 may be provided with a door 31 having a shaft 32 at a side opposite of the sheet supply tray 21 with the vertical sheet transfer path 29 in between for allowing the operator to access the scrap receptacle 27. As shown in FIG. 10(B), the operator rotates the door 31 around the shaft 32 to access the scrap receptacle 27 easily.

Figure 11:
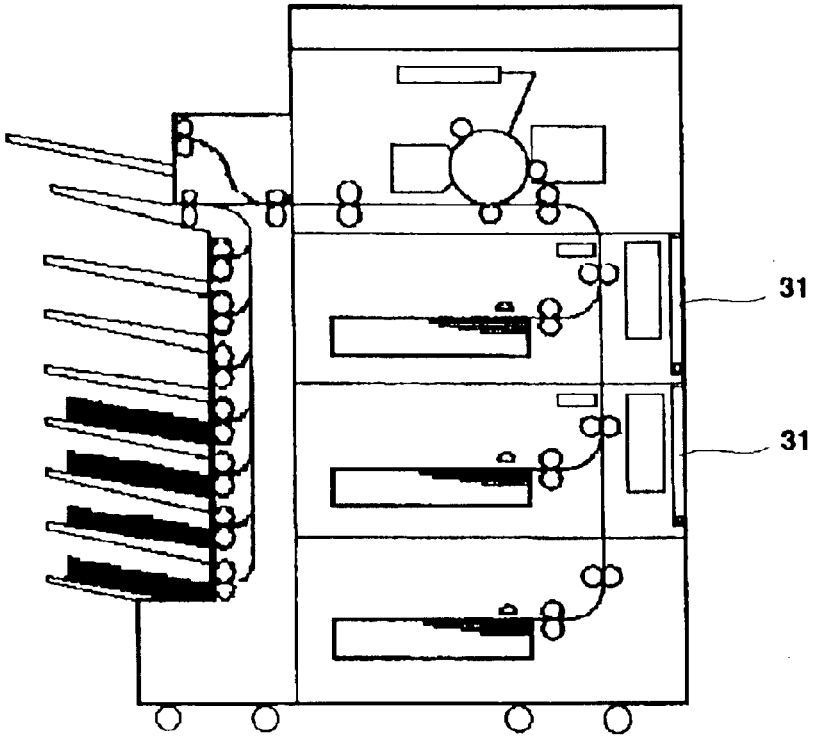
FIG. 11 is a sectional view of a copier of another embodiment to which the present invention is applicable.
Figure 12:
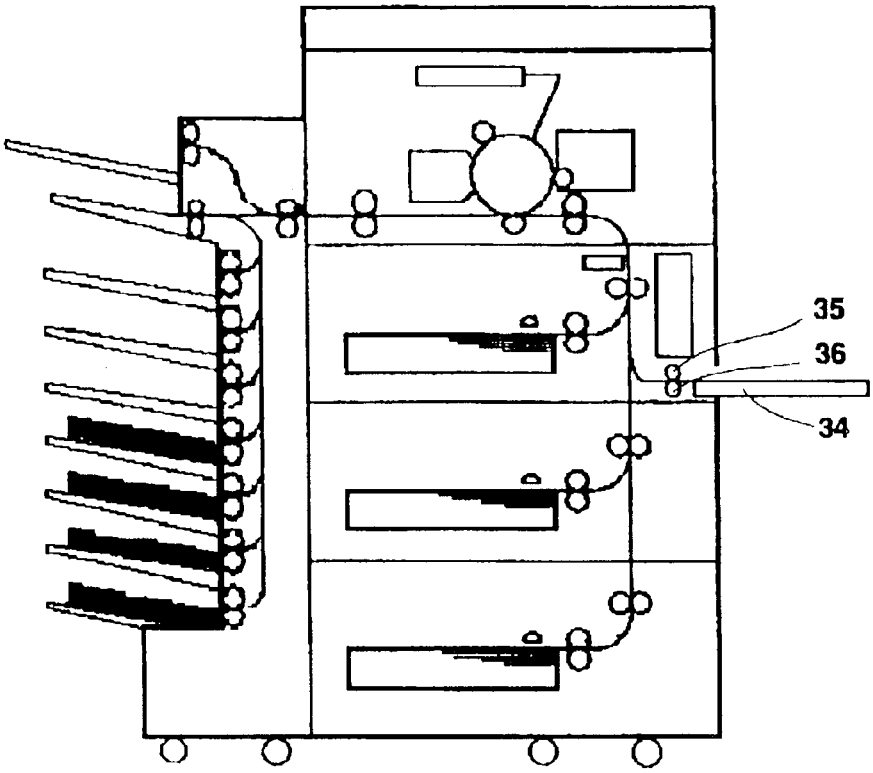
FIG. 12 is a sectional view of a copier of another embodiment to which the present invention is applicable.

Also, in this embodiment, only the sheet feeding unit 3*a* is provided with the mechanism for punching the hole in the sheet SH. As shown in FIG. 11, it is also perfectly acceptable to provide such a mechanism in the sheet feeding unit 3*b* (or sheet feeding unit 3*c*), and to form the door 31 in the sheet feeding unit 3*b* (or the sheet feeding unit 3*c*). With such a configuration, it is possible to compose the sheet feeding units using the same members. As shown in FIG. 12, it is possible to arrange the hand-feed tray 34 at upstream of the pair of the register rollers 25 for manually supplying the sheet. In this case, it is possible to use that same mechanism for punching the hole in the sheet SH fed not only from the sheet supply tray 21 also from the hand-feed tray 34. In this case, it is preferable to provide the sheet feeding roller 35 for feeding the sheet fed from the hand-feed tray 34 into the vertical sheet transfer path 29 and the separation roller 36 for pressing the roller.

In the embodiment, the sheet feeding apparatus 3 is separate from the image forming apparatus 2, and is detachably mounted to the image forming apparatus 2. It is also perfectly acceptable that the image forming apparatus 2 is formed in a unit with the sheet feeding apparatus 3. With such a configuration, the same effects and performance as those described above can be attained.

As describe above, according to the present invention, since the sheet feeding apparatus itself is provided with the hole punching means, the sheet is fed in a short distance from the storage means to the hole punching means, thereby reducing the skew (shift in the feeding direction) during the feeding. Therefore, it is easy to correct the skew of the sheet with the register means, and the hole punching means punches the hole in the sheet more accurately. Furthermore, the hole punching means where a paper jam easily occurs is disposed in the sheet feeding apparatus, and the sheets are fed from the sheet feeding means one at a time. Therefore, the subsequent sheet is not fed when the paper jam occurs, thereby reducing the wasted sheets.

What I claim is:

1. An image forming apparatus, comprising:

a sheet feeding device including storage means for stacking and storing a sheet; sheet feeding means for feeding the sheet one at a time from the storage means; register means or aligning a posture of the sheet transferred by the sheet feeding means; and transfer means for transferring the sheet with the posture aligned in a downstream direction, image forming means for forming a desired image on the sheet transferred by the transfer means, and hole punching means disposed between the register means and the image forming means for punching a hole in the sheet with skew removed by the register means.

2. An image forming apparatus according to claim 1, wherein said hole punching means comprises a hole punching member for punching the hole in the sheet with the skew removed, and scrap receptacle means for receiving a hole punch scrap of the sheet with the hole punched by the hole punching member.

3. An image forming apparatus according to claim 1, further comprising support means for supporting the storage means and the hole punching means to be movable between a sheet feeding position where the sheet feeding means feeds the sheet one at a time and a refilling position for refilling the sheet to the storage means.

4. An image forming apparatus according to claim 1, further comprising hand-feed means arranged at upstream of the hole punching means for feeding the sheet manually.

5. An image forming apparatus according to claim 1, wherein said hole punching means is formed as a part of the sheet feeding device.

6. A sheet feeding apparatus detachably mounted to an image forming apparatus for supplying a sheet, comprising:

storage means for stacking and storing the sheet;

sheet feeding means for feeding the sheet from the storage means one at a time;

register means for abutting against a leading edge of the sheet fed by the sheet feeding means in a sheet feeding direction, and for allowing the sheet to move toward downstream after removing skew of the sheet by curling the sheet;

a sheet feed path for guiding the sheet fed by the sheet feeding means substantially vertically;

hole punching means for punching a hole in the sheet guided by the sheet feed path;

scrap receptacle means disposed along the sheet feed path for receiving a hole punch scrap of the sheet with the hole punched by the hole punching means, and support means for supporting the storage means and the hole punching means to be movable between a sheet feeding position where the sheet feeding means feeds the sheet one at a time and a refilling position for refilling the sheet to the storage means.

7. A sheet feeding apparatus according to claim 6, wherein said scrap receptacle means is arranged at a side opposite to the sheet feeding means with the sheet feed path in between.

8. A sheet feeding apparatus according to claim 7, further comprising opening and closing means arranged on a side opposite to the sheet feeding means with the sheet feed path in between for allowing an operator to access the scrap receptacle means.

9. A sheet feeding apparatus according to claim 6, further comprising hand-feed means arranged at upstream of the hole punching means for feeding the sheet manually.

10. A sheet feeding apparatus detachably mounted to an image forming apparatus, comprising:

a plurality of sheet feeding units arranged to be stackable in a vertical direction, each of said sheet feeding units having storage means for stacking and storing the sheet; sheet feeding means for feeding the sheet from the storage means one at a time; and a sheet feed path for guiding the sheet fed by the sheet feeding means to the image forming apparatus, at least one of said sheet feeding units being situated at farthermost downstream in a sheet feeding direction and comprising hole punching means for punching a hole in the sheet guided in the sheet feed path.

11. A sheet feeding apparatus according to claim 10, wherein said at least one of the sheet feeding units situated at farthermost downstream in the sheet feeding direction further comprises register means for abutting against a leading edge of the sheet fed by the sheet feeding means in the sheet feeding direction, and for allowing the sheet to move toward downstream after removing skew of the sheet by curling the sheet.

12. A sheet feeding apparatus according to claim 10, wherein said sheet feeding path is formed in a substantially vertical direction.

13. A sheet feeding apparatus according to claim 10, wherein said at least one of the sheet feeding units situated at farthermost downstream in the sheet feeding direction further comprises scrap receptacle means disposed along the sheet feed path for receiving a hole punch scrap of the sheets with the hole punched by the hole punching means.

14. A sheet feeding apparatus according to claim 13, wherein said scrap receptacle means is arranged at a side opposite to the sheet feeding means with the sheet feed path in between.

15. A sheet feeding apparatus according to claim 14, further comprising opening and closing means arranged on a side opposite to the sheet feeding means with the sheet feed path in between for enabling an operator to access the scrap receptacle means.

16. A sheet feeding apparatus according to claim 10, further comprising support means for supporting the storage means and the hole punching means to be movable between a sheet feeding position where the sheet feeding means feeds the sheet one at a time and a refilling position for refilling the sheet to the storage means.

17. A sheet feeding apparatus according to claim 10, further comprising hand-feed means arranged at upstream of the hole punching means for feeding the sheet manually.

18. An image forming apparatus comprising:

storage means for stacking and storing a sheet;

sheet feeding means for feeding the sheet from the storage means one at a time;

register means for aligning the sheet fed by the sheet feeding means;

transfer means for transferring the sheet aligned by the register means toward downstream;

image forming means for forming a desired image on the sheet transferred by the transfer means; and hole punching means disposed between the register means and the image forming means for punching a hole in the sheet aligned by the register means.

19. An image forming apparatus according to claim 18, wherein said image forming means is situated away from the register means by a distance longer than a length of the sheet in a sheet feeding direction stored in the storage means.

* * * * *